US009816775B2

(12) United States Patent
Miller

(10) Patent No.: US 9,816,775 B2
(45) **Date of Patent: *Nov. 14, 2017**

(54) BALANCED PULLEY ASSEMBLY FOR COMPOUND ARCHERY BOWS, AND BOWS INCORPORATING THAT ASSEMBLY

(71) Applicant: MCP IP, LLC, Sparta, WI (US)

(72) Inventor: Larry D. Miller, Rochester, MI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/243,736

(22) Filed: Aug. 22, 2016

(65) Prior Publication Data

US 2016/0356570 A1 Dec. 8, 2016

Related U.S. Application Data

(63) Continuation of application No. 14/586,244, filed on Dec. 30, 2014, now Pat. No. 9,423,201, which is a continuation of application No. 13/899,422, filed on May 21, 2013, now Pat. No. 8,919,333, which is a continuation of application No. 12/820,405, filed on Jun. 22, 2010, now Pat. No. 8,443,791, which is a continuation-in-part of application No. 12/110,447, filed on Apr. 28, 2008, now Pat. No. 7,946,281.

(60) Provisional application No. 61/219,567, filed on Jun. 23, 2009, provisional application No. 60/946,495, filed on Jun. 27, 2007.

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01)

(58) Field of Classification Search
CPC ..... F41B 5/10; F41B 5/105
See application file for complete search history.

(56) References Cited

U.S. PATENT DOCUMENTS

| | | | |
|---|---|---|---|
| 3,486,495 | A | 12/1969 | Allen |
| 3,990,425 | A | 11/1976 | Ketchum |
| 4,337,749 | A | 7/1982 | Barna |
| 4,338,910 | A | 7/1982 | Darlington |
| 4,440,142 | A | 4/1984 | Simonds |
| 4,461,267 | A | 7/1984 | Simonds et al. |
| 4,515,142 | A | 5/1985 | Nurney |
| 4,519,374 | A | 5/1985 | Miller |
| 4,660,536 | A | 4/1987 | McPherson |
| 4,672,943 | A | 6/1987 | Bozek |

(Continued)

OTHER PUBLICATIONS

Mullaney, "Bow Report: Browning Safari," Archery World magazine, Feb./Mar. 1979, cover and pp. 28-29, 42.

*Primary Examiner* — John Ricci

(57) ABSTRACT

A compound bow includes a first and second pulley, each of which is operative, when the bow is drawn, to unwind a portion of a bow string from a bow string groove and to take up a portion of a bow cable so as to decrease its effective length. At least one of the pulleys includes a cable controller which operates to modify the rate at which the effective length of the bow cable is decreasing so that during an initial portion of the draw of the bow, the rate is greater than it would be in the absence of the controller, and during a second portion of the draw, the rate is less than it would be in the absence of the controller. Use of the controller provides a bow which has an inherently balanced draw.

20 Claims, 7 Drawing Sheets

(56) References Cited

U.S. PATENT DOCUMENTS

| | | | |
|---|---|---|---|
| 4,686,955 | A | 8/1987 | Larson |
| 4,748,962 | A | 6/1988 | Larson |
| 4,774,927 | A | 10/1988 | Larson |
| 4,926,833 | A | 5/1990 | Darlington |
| 4,957,094 | A | 9/1990 | Pickering et al. |
| 4,967,721 | A | 11/1990 | Larson |
| 5,211,155 | A | 5/1993 | Zamojski |
| 5,368,006 | A | 11/1994 | McPherson |
| 5,381,777 | A | 1/1995 | Mitchell et al. |
| 5,505,185 | A | 4/1996 | Miller |
| 5,678,529 | A | 10/1997 | Larson |
| 5,782,229 | A | 7/1998 | Evans et al. |
| 5,791,322 | A | 8/1998 | McPherson |
| 5,791,323 | A | 8/1998 | Dunlap |
| 5,890,480 | A | 4/1999 | McPherson |
| 5,934,265 | A | 8/1999 | Darlington |
| 5,960,778 | A | 10/1999 | Larson |
| 5,975,067 | A | 11/1999 | Strother |
| 6,035,840 | A | 3/2000 | McPherson |
| 6,082,346 | A | 7/2000 | Andrews et al. |
| 6,082,347 | A | 7/2000 | Darlington |
| 6,112,732 | A | 9/2000 | Larson |
| 6,247,466 | B1 | 6/2001 | McPherson |
| 6,321,736 | B1 | 11/2001 | McPherson |
| 6,415,780 | B1 | 7/2002 | Proctor |
| 6,443,139 | B1 | 9/2002 | McPherson |
| 6,474,324 | B1 | 11/2002 | Despart et al. |
| 6,516,790 | B1 | 2/2003 | Darlington |
| 6,666,202 | B1 | 12/2003 | Darlington |
| 6,688,295 | B1 | 2/2004 | Miller |
| 6,763,818 | B2 | 7/2004 | Larson |
| 6,792,930 | B1 | 9/2004 | Kronengold et al. |
| 6,990,970 | B1 | 1/2006 | Darlington |
| 6,994,079 | B1 | 2/2006 | Darlington |
| 7,047,958 | B1 | 5/2006 | Colley |
| 7,188,615 | B2 | 3/2007 | Chang |
| 7,305,979 | B1 | 12/2007 | Yehle |
| 7,441,555 | B1 | 10/2008 | Larson |
| 7,938,109 | B1 | 5/2011 | Larson |
| 7,946,281 | B2 | 5/2011 | Miller |
| 7,971,582 | B1 | 7/2011 | Larson |
| 8,020,544 | B2 | 9/2011 | McPherson et al. |
| 8,069,848 | B1 | 12/2011 | Larson |
| 8,181,638 | B1 | 5/2012 | Yehle |
| 8,281,775 | B1 | 10/2012 | Larson |
| 8,443,791 | B2 | 5/2013 | Miller |
| 8,919,333 | B2 | 12/2014 | Miller |
| 9,423,201 | B2 | 8/2016 | Miller |
| 2008/0135032 | A1 | 6/2008 | Islas |
| 2009/0000607 | A1 | 1/2009 | Miller |

BALANCED PULLEY ASSEMBLY FOR COMPOUND ARCHERY BOWS, AND BOWS INCORPORATING THAT ASSEMBLY

CROSS-REFERENCE TO RELATED APPLICATIONS

This application is a continuation of U.S. patent application Ser. No. 14/586,244, filed Dec. 30, 2014, which is a continuation application of U.S. patent application Ser. No. 13/899,422, filed May 21, 2013, now U.S. Pat. No. 8,919,333, which is a continuation application of U.S. patent application Ser. No. 12/820,405 filed Jun. 22, 2010, which claims priority of U.S. Provisional Patent Application No. 61/219,567 filed Jun. 23, 2009, entitled "Dual Feed-Out Archery Cam", which is incorporated herein by reference. U.S. patent application Ser. No. 12/820,405 is also a continuation-in-part of U.S. patent application Ser. No. 12/110,447 filed Apr. 28, 2008, entitled "Balanced Pulley Assembly For Compound Archery Bows, And Bows Incorporating That Assembly," which in turn claims priority of U.S. Provisional Patent Application No. 60/946,495 filed Jun. 27, 2007, entitled "Balanced Pulley Assembly for Compound Archery Bows, and Bows Incorporating That Assembly", which is incorporated herein by reference.

FIELD OF THE INVENTION

This invention relates generally to archery. More specifically, the invention relates to compound archery bows, and specifically, the invention relates to a pulley assembly for compound archery bows wherein tension on the control cables during the draw cycle of the bow is varied so as to provide for an inherently balanced draw, and for optimum control of the force/draw profile.

BACKGROUND OF THE INVENTION

A compound archery bow includes a bow string operative in conjunction with a set of particularly configured pulleys, and one or more bow cables. In a typical compound bow, the pulleys (also termed cams) are configured so that when the bow string is drawn, the cables are wound into grooves on the pulleys, thereby decreasing their effective length, and storing energy in the bow. In a bow of this type, the force required to displace the bow string (i.e. the draw force) varies as a function of the draw length, and this is termed the force/draw profile. In a typical compound bow, the force/draw profile is selected so that, initially, a relatively high level of force is required to displace the bow string, and thereafter the force required for further displacement decreases. This decrease is termed "drop off" and allows for the bow to be held at full draw with a minimized force. The force/draw characteristics of a compound bow allow storage of a high degree of mechanical energy resulting in higher velocity and a flatter path of travel for the arrow. An early design of compound bows is shown in U.S. Pat. No. 3,486,495.

Most compound bows include two specialized pulleys (also referred to as cams), and it is necessary to ensure that the two pulleys operate in synchrony. This is referred to as timing or balance. If a bow is out of balance, uneven forces can be applied to the bow string compromising accuracy. As will be explained in detail hereinbelow, the present invention provides for a pulley system for archery bows which is inherently self-balancing. This self-balancing pulley assembly is referred to by the inventor hereof as the "Libra" assembly, and trademark rights are claimed therein. In addition to being self-balancing, the Libra self-balancing pulley assembly provides for an improved force/draw profile wherein an increased amount of energy may be stored in the bow during the initial portion of the draw cycle. As will be further described, the pulley assembly includes a uniquely configured design of pulley which may be used with a like pulley, or with pulleys of other design.

BRIEF DESCRIPTION OF THE INVENTION

Disclosed herein is a compound archery bow comprised of a handle having a first and second limb projecting therefrom with a first pulley mounted on a first of the limbs for rotation about a first pivot axis and a second pulley mounted on a second one of the limbs for rotation about a second pivot axis. Each of the pulleys includes a bow string let-out groove, a bow cable take-up groove and a cable controller. A bow string extends from the bow string let-out groove of the first pulley to the bow string let-out groove of the second pulley. The bow further includes a first cable having a first end thereof affixed to the controller of the first pulley. The first cable extends to the cable take-up groove of the second pulley. The bow further includes a second bow cable having a first end thereof affixed to the controller of the second pulley. The second cable extends to the cable take-up groove of the first pulley. The bow is configured so that when the bow string is drawn in a direction away from the handle, a portion of the bow string is unwound from the respective bow string let-out grooves of the first and second pulleys, and a portion of the length of the first bow cable is wound into the cable take-up groove of the second pulley, and a portion of the length of the second bow cable is wound into the take-up groove of the first pulley. The cable controller of each of said pulleys is operative so as to cause the first end of the cable attached thereto to move relative to its respective pivot axis, in a direction running at least in part, from said handle, towards said respective pivot axis and thence towards said bow string so that the controller initially takes up a portion of the effective length of the cable relative to a horizontal line through its pivot axis and thereafter lets out a portion of the effective length of the cable relative to a horizontal line through its respective pivot axis.

In some embodiments, one or both of the controllers comprise a pivotable member; and in specific instances, the pivotable member includes a first end which is pivotally affixed to its respective pulley and a second, free end. In this embodiment, the first end of the cable is affixed to the free end of its respective pivotable member. In other instances, the pivotable member comprises a rotatable collar.

In other instances, one or both of the cable controllers comprise a spool which travels in the curved path. The spool is operable to take up a portion of the length of the cable during the initial portion of the draw of the bow string and to let out a portion of the length of the cable during the second portion of the draw of the bow string.

Also disclosed herein is a pulley assembly for use in a compound bow. The pulley assembly may be used in conjunction with a like pulley or with a differently configured pulley. The pulley assembly includes an axle journal which defines a pivot axis about which the pulley assembly is rotatable. The pulley further includes a pulley body including a first and second groove defined therein. Each groove describes a curve which extends at least partway around the pivot axis. The first groove of each pulley is a bow string groove operative to receive a portion of a bow string therein and the second groove of each pulley is a bow cable groove which is configured to receive a portion of a first bow cable section therein when said pulley is incorporated into a compound bow assembly. The pulley assembly further includes a cable controller having a first portion which is pivotally affixed to the pulley body and a second portion which is free of the pulley body. The second portion is configured to have an end of a second bow cable affixed thereto once the pulley assembly is incorporated into a bow.

Further disclosed are compound bows which include at least one pulley which is operative, when the bow is drawn, to unwind a portion of a bow string from a bow string groove so as to increase its effective length and to wind up a portion of a bow cable so as to decrease its effective length. The pulleys of such bows further include a cable controller, and the cable controllers operate during a first portion of the draw of the bow to increase the rate at which the effective lengths of the bow cables are decreasing as compared to the rate at which the lengths would be decreasing the absence of the controller. The controller further operates during a second portion of the draw to decrease the rate at which the effective lengths of the cables are decreasing as compared to the rate at which the lengths would be decreasing in the absence of the controller.

DETAILED DESCRIPTION OF THE INVENTION

The present invention is directed to an archery bow system referred to as the Libra system. The Libra system includes uniquely configured, self-balancing bow pulleys (also referred to as cams) which provide for an inherently balanced bow system. The pulleys incorporate bow cable controllers which control the motion of the bow cables so as to maintain the bow in balance during the time it is being drawn and released. The system will be described, primarily, with reference to one particular configuration of bow and pulley; however, the principles of the present invention may be implemented in a variety of other configurations in accord with the teaching presented herein. In the following description, various elements may be described as being: upper, lower, top, bottom, vertical or horizontal. It is to be understood that these terms are relative, and are used to make clear spatial relationships between the various members; and as such, such terms may be used interchangeably.

Figure 1:
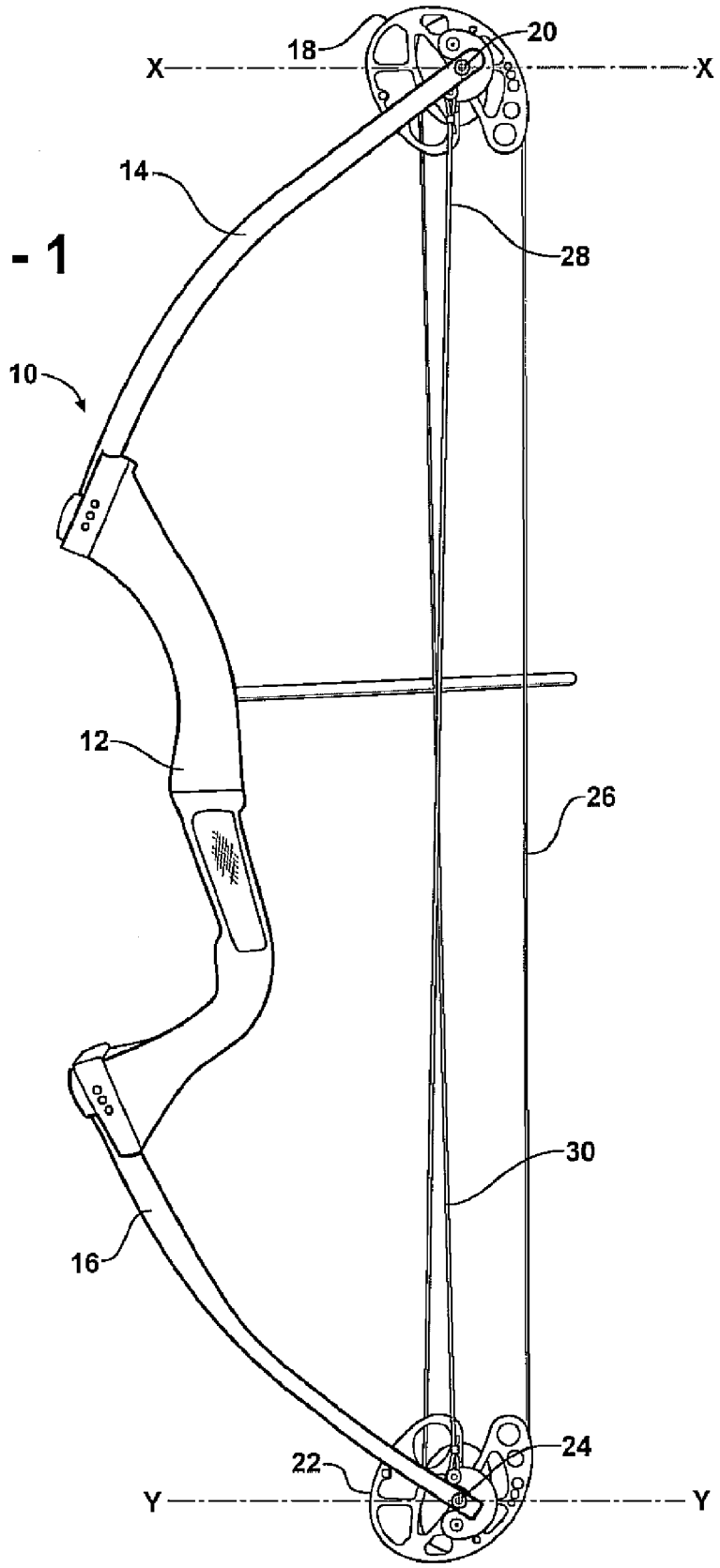
FIG. 1 is a side elevation view of a compound archery bow which includes a first and second pulley in accord with the present invention.

Referring now to FIG. 1, there is shown a side elevation view of an archery bow 10 which further includes a handle portion 12 having a first limb 14 and a second limb 16 projecting therefrom. As illustrated in FIG. 1, the limbs 14 and 16 comprise separate elements affixed to the handle; however, it is to be understood that in some instances, the limbs and handle may comprise a single, unitary body. In the operation of the bow, the limbs 14 are flexible and serve to store energy when the bow is drawn and deliver that energy to an arrow (not shown) when the bow is released. As is further shown in FIG. 1, the bow 10 includes a first, top, pulley 18 pivotally affixed to the first limb 14 at a first pivot axis 20. In the illustration, the ends of the bow are forked, and the pulleys are mounted within the forked portions. Other pulley mounting arrangements may be implemented. Similarly, the bow 10 includes a second, bottom, pulley 22 pivotally affixed to the second limb 16 at a second pivot axis 24. A bow string 26 extends between the first pulley 18 and the second pulley 22. A first bow cable 28 extends from the first pulley 18 to the second pulley 22; and likewise, a second bow cable 30 extends from the second pulley 22 to the first pulley 18. Details of the pulleys, bow string, and cables are better seen in FIG. 2.

Also shown in Figure I are horizontal reference lines X-X and Y-Y. These lines are included in these drawings for the purpose of explaining the operation of the pulleys 18, 22, with regard to the travel of the associated bow cables 28, 30. In these illustrations, the horizontal reference line X-X passes through the first pivot axis 20 in a direction which is at right angles to the length of the bow string 26, when it is in an undrawn position. The horizontal reference line Y-Y passes through the second pivot axis 24 in a direction which is at right angles to the length of the bowstring 26, when it is in an undrawn position. As such, while the reference lines X-X and Y-Y are described as "horizontal reference lines," depending on the orientation of the bow 10, they may not be disposed horizontally in relation to the surface of the earth.

Figure 2:
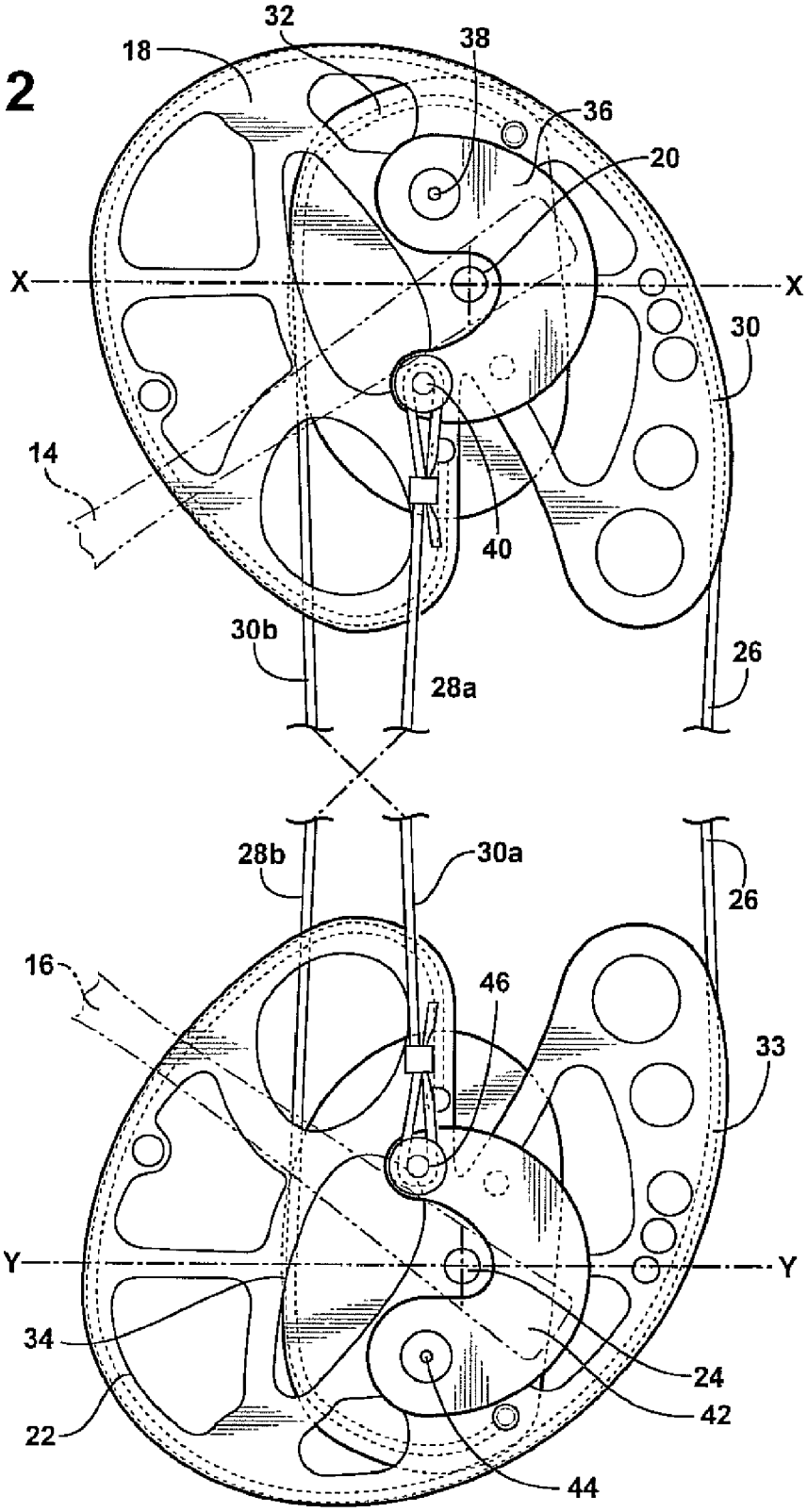
FIGS. 2-5 depict the pulleys, and portions of the bow string and bow cables of the bow of FIG. 1 in successive stages of the draw of the bow string so as to illustrate the operation of one embodiment of cable controller of the present invention.

FIG. 2 is a side elevation view of the first pulley 18 and second pulley 22 of FIG. 1 better illustrating the features thereof. In that regard, the pulleys of FIG. 2 are shown as including segments of the bow string 26, first cable 28 and second cable 30. Also, portions of the upper limb 14 and lower limb 16 are shown in phantom outline.

As will be seen in FIG. 2, the first pulley 18 is pivotally supported on the limb 14 at a first pivot axis 20, which in this instance comprises an axle about which the pulley 18 rotates. The pulley 18 includes a bow string let-out groove 30 running about a portion of its outer circumference. As shown in FIG. 2, a portion of the bow string 26, as detailed in phantom outline, is disposed in this groove. As the pulley rotates, the bow string 26 will be alternately let out and taken up from the groove 30. The pulley 18 further includes a cable take-up groove 32, and as illustrated, a portion of the second bow cable **30*b* is shown, in phantom outline, as being wound thereinto. Similarly, the second pulley 22 includes a bow string let-out groove 32 and a cable take-up groove 34**. It is to be understood that the terms "let-out" and "take-up" are relative, since these grooves both let out and take up corresponding cable and bow string sections during the draw and release of the bow, as will be detailed hereinbelow.

As is further shown in FIG. 2, the first pulley 18 includes a cable controller 36. In this embodiment, the cable controller 36 is a curved element which is pivotally affixed to the pulley 18 at a pivot point 38. The controller has a second end 40, which is a free end, which is capable of moving relative to the pulley 18. As illustrated, a first end of the first cable **28*a* is affixed to the controller 36 of the first pulley 18 at its free end 40; although, it is to be understood that it may be affixed to the controller 36** at another location.

The second pulley 22 is correspondingly configured with regard to its controller 42. As illustrated, the controller 42 is pivotally affixed to the second pulley at a pivot point 44, and it includes a second, free end 46 which has a first end of the second cable 30*a* affixed thereto.

Figure 3:
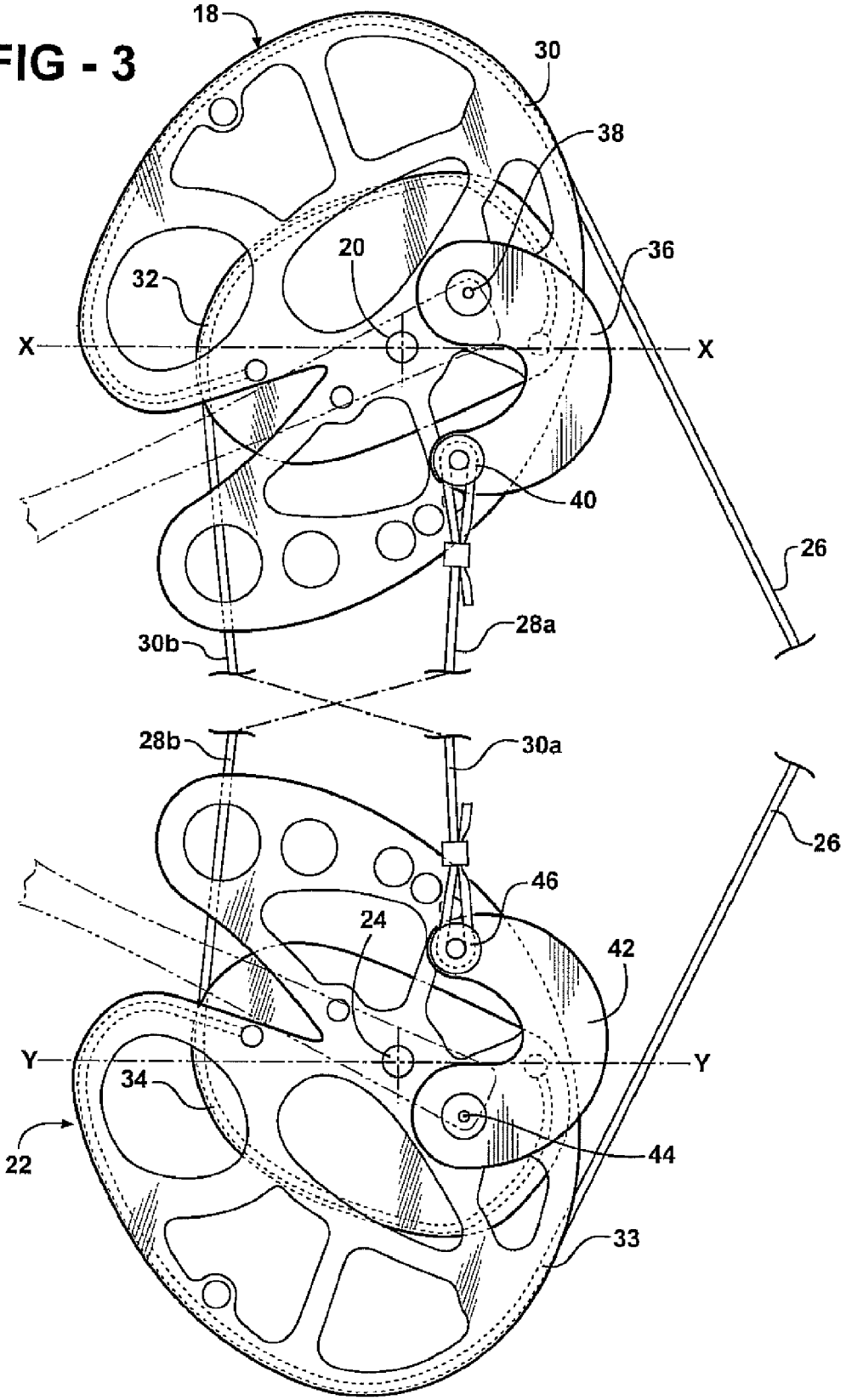
Figure 4:
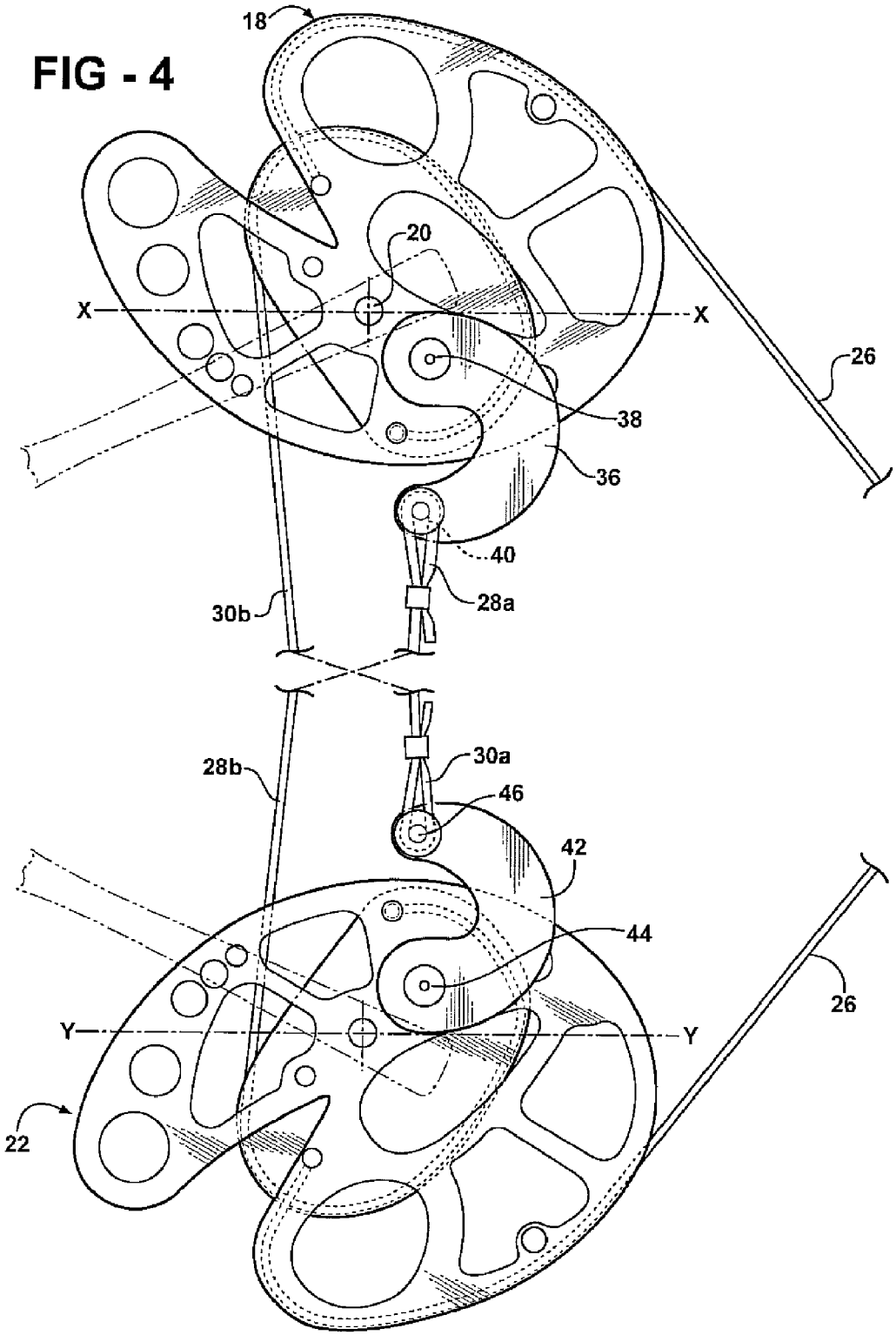
Figure 5:
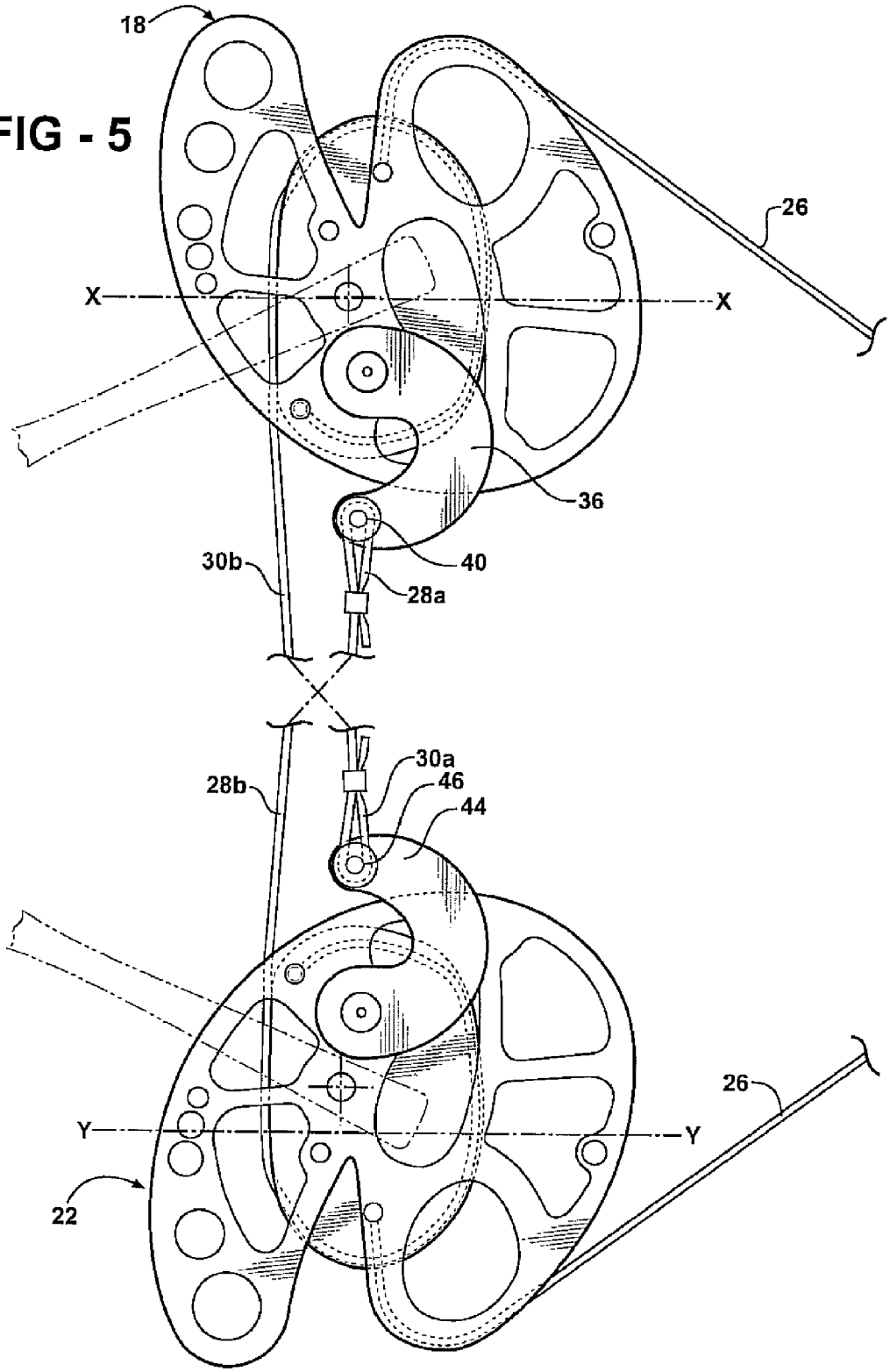

The FIG. 2 illustration shows the relative position of the pulleys, bow string and cables when the bow is in an undrawn position. FIGS. 3-5 show the same structures in various stages of draw and illustrate the operation of the cable controllers. As will be seen in FIG. 3, the bow string 26 has been drawn in a direction away from the bow handle (not shown) and in so doing, causes the first pulley 18 to rotate in a clockwise direction as seen in this view, and correspondingly causes the second pulley 22 to rotate in a counterclockwise direction. This rotation causes portions of the bow string 26 to be let out from the corresponding bow string let-out grooves 30, 33 of the respective pulleys. This rotation also causes a portion of the second bow cable 30 to be taken up by the cable take-up groove 32 of the first pulley, and a portion of the first bow cable 28 to be taken up by the take-up groove 34 of the second pulley 22. When the bow cables 28, 30 are taken up by the pulleys, their effective lengths are decreased; and in this regard the "effective length" of the cables is understood to be that portion of the cable which is not wound about a pulley.

As the pulleys 18, 22 rotate about their respective pulley axes 20, 24, the pivot points 38, 44 at which their associated controllers 36, 42 are attached likewise rotate. Specifically, the pivotal attachment point 38 of the controller 36 associated with the first pulley 18 travels in a counterclockwise, curved path from its position in FIG. 2 to its position in FIG. 3. This motion displaces the free end 40 of the controller 36 and the associated end of the first cable 28 to move relative to the pivot axis 20. As shown in FIG. 3, this path of travel is generally directed from the handle portion of the bow toward the bow string 26. In a first portion of the draw of the bow string 26, the controller 36 causes the end of the first cable 28 affixed thereto to travel in a direction upward (away from the handle 12) relative to the horizontal reference line X-X. This displacement effectively causes the controller to initially take up a portion of the length of the cable 28 relative to the pivot axis 20, and thereby causes the effective length of the associated bow cable 28 (which is also being taken up by the second pulley 22) to decrease at a greater rate than it would in the absence of the controller.

The controller 42 of the second pulley 22 likewise causes the free end 46 thereof to move the end of the second cable 30 in a path of travel which is downward (away from the handle 12) relative to the horizontal reference line Y-Y. This motion causes the controller 42 to initially take up a portion of the length of the second cable 30 and likewise causes the effective length of the second cable 30 to decrease at a greater rate than it would in the absence of the controller 42.

Referring now to FIG. 4, there is shown a further stage in the draw of the bow. As will be seen, the pulleys 18, 22 have rotated still further, and more of the bow string 26 is unwound therefrom. Correspondingly, the attachment point 38 of the controller 36, of the first pulley 18 has moved still further in a counterclockwise direction. However, the free end 40 of this controller 36 has moved in a relatively downward direction with regard to the horizontal reference line X-X (toward the handle 12); and correspondingly, so has the first end 28*a* of the first cable. This displacement causes the controller 36 to let out a length of the cable 28*a* relative to the pivot axis 20. As a result, during this phase of the draw, the effective length of the cable 28 decreases at a lesser rate than it would in the absence of the controller 36. Similar motion is achieved by the controller 42 of the second pulley 22 which moves the first end of the second cable 30*a* in an upward direction relative to the horizontal reference line Y-Y (toward the handle 12), and thereby lets out a length of the second cable 30, likewise altering its rate of effective decrease. As mentioned previously, the terms "upward" and "downward" are used in a relative sense in this description.

FIG. 5 shows a further stage when the bow is fully drawn. In this figure, the bow string 26 is unwound from the pulleys 18 and the bow is ready for release. Upon release, the force stored in the limbs will cause the pulleys to take up the bow string and let out the cables thereby reversing the series of steps previously illustrated.

Figure 6:
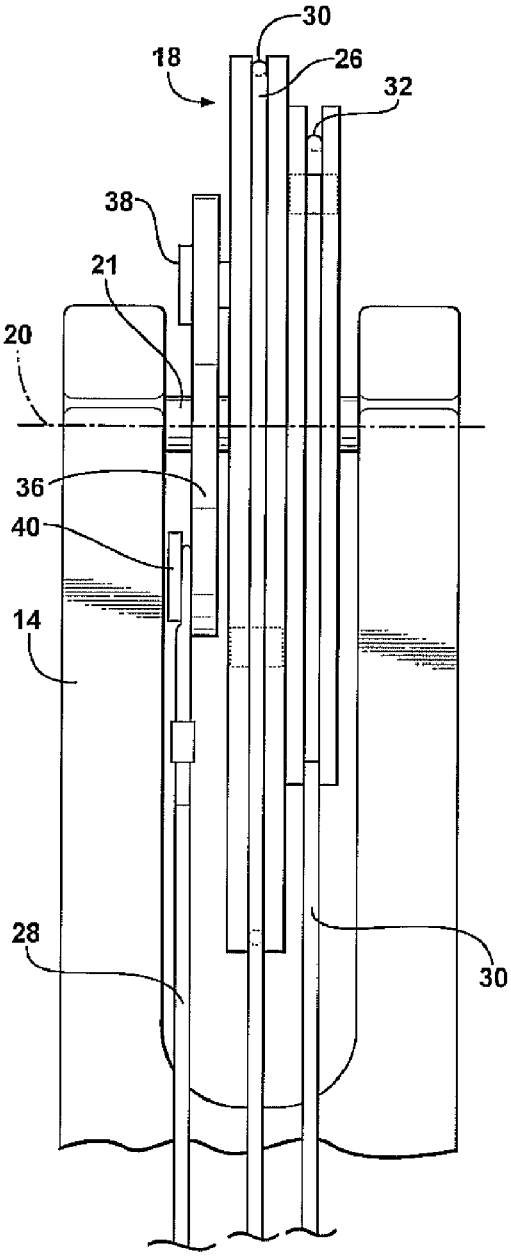
FIGS. 6 and 7 are end views of the top pulley assembly of the Figure I embodiment in two different stages of the draw of the bow string.

Referring now to FIG. 6, there is shown an end view of the upper portion of the bow of FIG. 1 illustrating the pulley 18 in a position of draw corresponding generally to that of FIG. 2. The FIG. 6 illustration shows the pulley 18 as pivotally supported at the first pivot axis 20 by an axle 21 which is retained by the upper limb 14. The pulley includes a bow string let-out groove 30 having a portion of a bow string 26 retained therein. The pulley 18 further includes a cable take-up groove 32 showing a portion of a second bow cable 30 retained therein.

As illustrated, the controller 36 is pivotally supported on the pulley 18 at a pivot point 38 and it includes a free end 40 having a first end of a first bow cable 28 affixed thereto.

Figure 7:
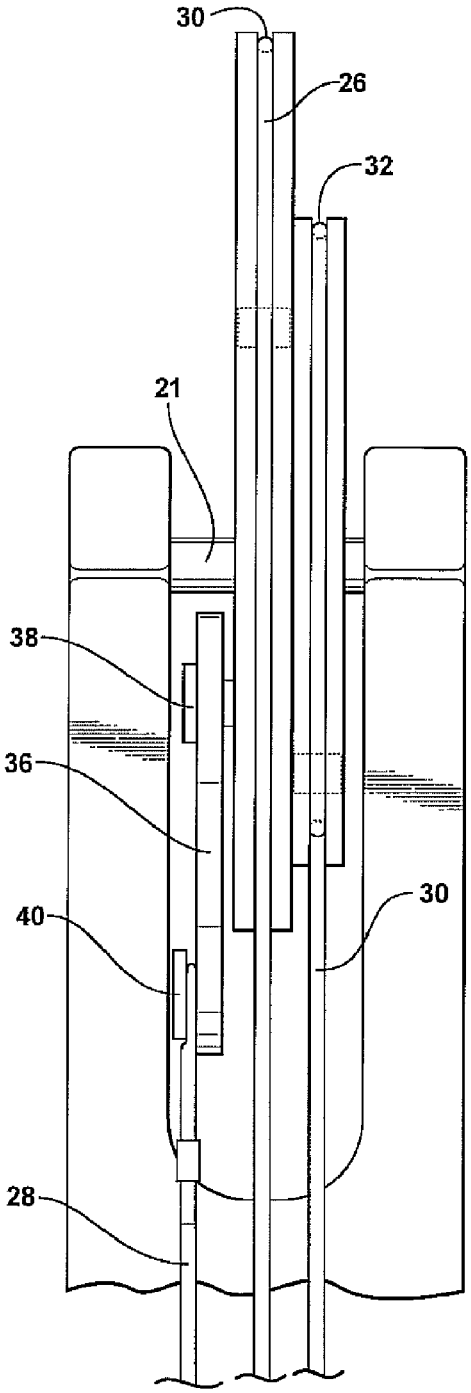

Referring now to FIG. 7, there is shown the pulley of FIG. 6 in a rotational configuration corresponding generally to FIG. 4 or FIG. 5. As will be seen, the pulley 18 has rotated so as to let out a portion of the bow string 26 and take up a portion of the second bow cable 30. The controller 36 has been displaced, and accordingly has let out a portion of the length of the first bow cable 28 relative to the first pivot axis 20.

As will thus be seen, the pulley assembly of the present invention operates, during the draw of the bow with which it is associated, to initially take up and then let out some portion of the length of the bow cable. The net effect is that, while the effective lengths of the bow cables are being continuously shortened during the drawing of the bow (as is the case in conventional compound bows), the controller operates to decrease the rate of shortening during a second portion of the draw; and in most instances, depending on the particular configuration of the pulley and controller, it operates to increase the rates of shortening of the cables during an initial portion of the draw. When the bow string is released, the controllers reverse their effect on the rate of change of the effective length of the bow cables so that during a first portion of the release, the rate at which the length of the cables increases is less than it would be in the absence of the controller. Likewise during the final portion of the release cycle, the rate will be greater. This moderation of the rates is significant since if two of such pulleys are used, they operate in an inherently balanced manner since, during the portion of the operational cycle in which the cable is let out or taken up, the two cooperate to provide a positive feedback which synchronizes the rotation of the two pulleys. As such, bows which incorporate the present pulley system are inherently balanced in their operation and are always "in tune".

Another inherent advantage of the system of the present invention is that the components of the first and second pulleys may be made to be symmetrical with regard to one another. This is significant since the two pulley assemblies may be prepared from identical parts. Therefore, tooling, inventory and assembly are greatly simplified.

Figure 8:
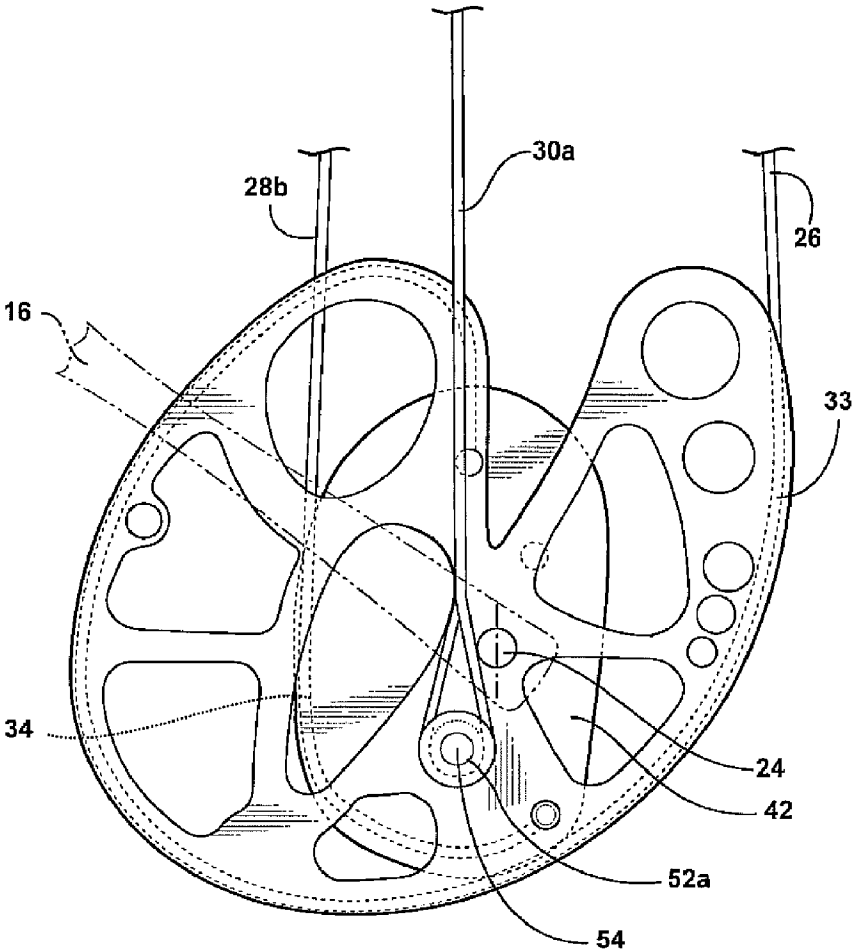
FIG. 8 is a side view of another embodiment of pulley configured in accordance with the present invention.

The present invention may be implemented in a number of other configurations. Referring now to FIG. 8, there is shown a pulley 50, which in this instance is disposed as the lower pulley of a bow, in accord with the present invention.

Figure 9:
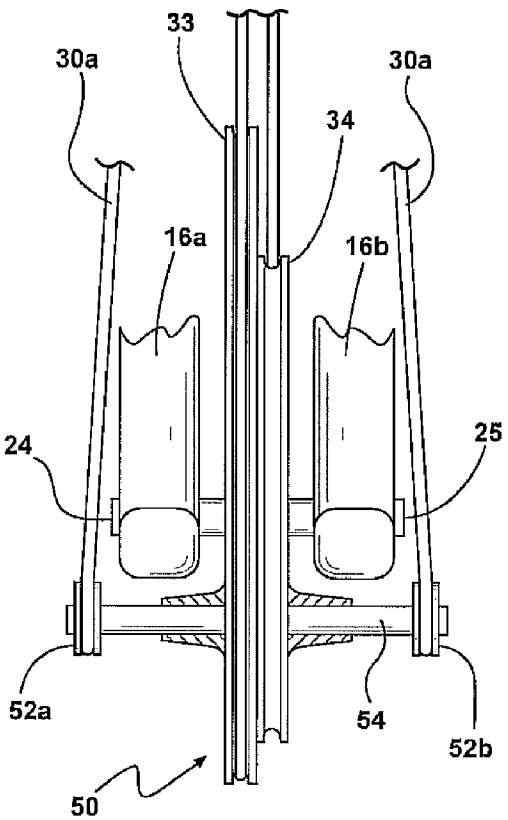
FIG. 9 is an end view of the pulley of FIG. 8.

In this embodiment, the pulley 50 is mounted onto the lower limb 16*a* of a bow; again, in this instance, the lower limb 16 is forked so as to be split into two portions, 16*a* which is illustrated in FIGS. 8 and 16*b* which is better seen in FIG. 9. The pulley 50 is mounted to the bow by an axle member which passes through a lower pivot axis 24 as in the previous illustrations. This pulley 50 has a bow string take-up groove 33 as generally described above, and as illustrated in FIG. 8, a portion of a bow string 26 is wound thereinto. The pulley 50 also includes a bow cable take-up groove 34, as previously described, and a portion of a bow cable 28*b* is shown as being wound thereinto. In this embodiment, the controller 52 is configured as a rotatable collar which is pivotally supported on the pulley 50 so as to be rotatable. This cable controller 52 engages the end of a second bow cable 30*a* as previously described; however, since in this instance the pulley includes dual cable controllers as is best shown in FIG. 9, the end of the cable 30 is forked.

Referring now to FIG. 9, there is shown an end view of the pulley 50. As described with reference to FIG. 8, the pulley 50 is supported at a pivot point 24 by an axle 25 which engages a first 16*a* and a second 16*b* portion of a forked end of a bow limb. In this manner, the pulley 50 is rotatable about an axle 25 disposed along the pivot axis 24. As will be seen from FIG. 9, the pulley 50 includes a portion having a bow string let-out groove 33 and a bow cable take-up groove 34. Further visible in FIG. 9 is a first controller 52*a* and a second controller 52*b* which are supported on the pulley. Each controller 52*a*, 52*b* is rotatable about a controller axle 54. As in the previous embodiment, rotation of the pulley 50 when the bow string 26 is drawn will cause the controller 52 to initially take up a portion of the length of the bow cable 30 and thereafter let out a portion of the length of the bow cable. In this regard, the end of the bow cable will, since this is a lower pulley as illustrated, initially move upward relative to a horizontal reference line, and thereafter move downward relative to a horizontal reference line, as in the previous embodiments.

In the FIGS. 8 and 9 embodiment, the pulley is shown as including two separate controllers mounted on either side thereof in an embodiment wherein the pulley itself is internally supported between two forks of a bow limb. This type of dual controller, split limb arrangement may be implemented in accord with other configurations of controller. Likewise, a single controller version of this embodiment may likewise be implemented.

The system of the present invention may be implemented in yet other configurations. For example, the controller may comprise a nonrotating spool member which is rigidly affixed to the pulley at a location generally similar to the point at which the previously illustrated pivotable members are joined. As the bow is drawn, the spool member will travel relative to the pivot point and in so doing will initially wind up, and thereafter let out, a portion of the length of the corresponding cable so as to initially take up and thereafter let out a portion of its effective length relative to the pivot axis.

Yet other embodiments of controller may be implemented in the practice of this invention. As such, the controller may comprise any assembly which operates to take up and let out the associated cable segment so as to control the cables in the manner described above, and as such may include camming members, variously configured spools, and other embodiments and equivalents thereof. The variously configured pulleys and controllers may be used either singly or in combination in particular bow configurations.

As is known in the art, pulleys for compound bows may be configured to include adjustable segments which allow the profile of the various take-up and let-out groove surfaces to be changed. These adjustments can be achieved by movable segments, replaceable portions, extendable portions or the like. These embodiments are used to adjust the draw profile of the bow to suit a particular user's needs. The controller of the present invention may be embodied in all of such adjustable pulleys and will achieve the advantages described herein. Also, while the invention has been described with regard to bows having two pulleys which incorporate controllers, in some applications a single such pulley may be employed, The present invention may be implemented in a variety of bow configurations including handheld bows as well as crossbows, fixed mounting bows, electromechanical systems and the like. Accordingly, modifications and variations of the invention will be readily apparent to those of skill in the art in view of the teaching presented herein. All of such embodiments and modifications are within the scope of the present invention. All of the foregoing is meant to illustrate the invention, but is not meant to be a limitation upon the practice thereof.

The invention claimed is:

1. An archery bow comprising:

a riser;

a first limb and a second limb;

a first rotatable assembly coupled to the first limb, the first rotatable assembly configured to rotate about a first pivot axis, the first rotatable assembly comprising a bowstring track, a cam track and a cable anchor, the cable anchor configured to rotate about a first rotation axis, the first rotation axis offset from the first pivot axis;

a second rotatable assembly coupled to the second limb, the second rotatable assembly configured to rotate about a second pivot axis, the second rotatable assembly comprising a bowstring track, a cam track and a cable anchor, the cable anchor configured to rotate about a second rotation axis, the second rotation axis offset from the second pivot axis;

a bowstring extending from the first rotatable assembly to the second rotatable assembly;

a first cable having a first end and a second end, the first end arranged to be taken up by the cam track of the first rotatable assembly as the bow is drawn, the second end coupled to the cable anchor of the second rotatable assembly; and a second cable having a first end and a second end, the first end arranged to be taken up by the cam track of the second rotatable assembly as the bow is drawn, the second end coupled to the cable anchor of the first rotatable assembly.

2. The archery bow of claim 1, wherein the cable anchor of the first rotatable assembly comprises a first portion rotatable about the first rotation axis and a second portion rotatable about the first rotation axis.

3. The archery bow of claim 2, wherein the first portion and second portion are located on opposite sides of the bowstring track of the first rotatable assembly.

4. The archery bow of claim 3, the second end of the second cable comprising a first end portion and a second end portion, the first end portion attached to the first portion of the cable anchor, the second end portion attached to the second portion of the cable anchor.

5. The archery bow of claim 1, wherein first rotatable assembly compress a laterally extending post, the cable anchor supported by the laterally extending post.

6. The archery bow of claim 5, wherein the laterally extending post comprises a controller axle.

7. The archery bow of claim 1, the cable anchor of the first rotatable assembly comprising a rotatable collar.

8. The archery bow of claim 7, the second cable comprising a terminal loop that contacts the rotatable collar.

9. The archery bow of claim 7, wherein a lateral distance between the bowstring track and the rotatable collar of the first rotatable assembly is greater than a lateral distance between the bowstring track of the first rotatable assembly and the first limb, the lateral distances being measured in a direction parallel to the first pivot axis.

10. The archery bow of claim 7, the cable anchor of the second rotatable assembly comprising a rotatable collar.

11. The archery bow of claim 1, wherein in a brace condition, a force applied by the bowstring to the first rotatable assembly biases the first rotatable assembly in a first direction about the first pivot axis, and a force applied by the second cable to the first rotatable assembly biases the first rotatable assembly in a second direction about the first pivot axis, the second direction opposite the first direction.

12. The archery bow of claim 11, wherein in a drawn condition, a force applied by the second cable to the first rotatable assembly biases the first rotatable assembly in the first direction about the first pivot axis.

13. The archery bow of claim 1, wherein the first rotation axis moves in an arcuate path about the first pivot axis as the bow is drawn.

14. The archery bow of claim 1, the first cable second end comprises a forked end portion arranged to straddle the second rotatable assembly.

15. The archery bow of claim 1, the archery bow defining a plane that contains the first pivot axis and the second pivot axis, the archery bow having a brace condition and a drawn condition, wherein the cable anchor of the first rotatable assembly is oriented on a first side of the plane in the brace condition and is oriented on a second side of the plane in the drawn condition.

16. The archery bow of claim 15, wherein the cable anchor of the second rotatable assembly is oriented on the first side of the plane in the brace condition and is oriented on the second side of the plane in the drawn condition.

17. A compound archery bow comprising:

a handle having a first limb and a second limb projecting therefrom;

a first rotatable assembly mounted on said first limb and configured for rotation about a first pivot axis, and a second rotatable assembly mounted on said second limb for rotation about a second pivot axis, said first and second rotatable assemblies each including a bow string let-out groove, a cable take-up groove, and a cable controller;

a bow string extending from the bow string let-out groove of the first rotatable assembly to the bow string let-out groove of the second rotatable assembly;

a first bow cable having a first end thereof affixed to the controller of the first rotatable assembly, said first bow cable extending to the cable take-up groove of the second rotatable assembly;

a second bow cable having a first end thereof affixed to the controller of the second rotatable assembly, said second bow cable extending to the cable take-up groove of the first rotatable assembly;

said bow being configured such that when said bow string is drawn in a direction away from said handle, a portion of said bow string is unwound from the respective bow string let-out grooves of said first and second rotatable assemblies, and a portion of said first bow cable is wound into the cable take-up groove of the second rotatable assembly, and a portion of the second bow cable is wound into the cable take-up groove of the first rotatable assembly; and wherein said cable controller of each of said rotatable assemblies is operative so as to cause the first end of the bow cable attached thereto to move in an at least partially curved path relative to its respective pivot axis.

18. The bow of claim 17, wherein the cable controller of the first rotatable assembly comprises a pivotable member.

19. The bow of claim 18, wherein said pivotable member is a rotatable collar.

20. An assembly for a compound archery bow, said assembly comprising:

an axle journal which defines a pivot axis about which said assembly is rotatable;

a body, said body including a first and a second groove defined therein, each groove describing a curve which extends at least partway around said pivot axis, wherein said first groove is a bow string groove being configured to receive a portion of a bow string therein, and wherein said second groove is a bow cable groove operative to receive a portion of a first bow cable section therein when said assembly is incorporated into a bow; and a cable controller which comprises a first and a second rotatable collar, the first rotatable collar being pivotally affixed to a first side of the body and the second rotatable collar being affixed to a second side of the body wherein said first and second rotatable collars are each configured to have a respective portion of a forked end of a second bow cable affixed thereto when said pulley assembly is incorporated into a bow.

* * * * *